US010422251B2

(12) United States Patent
Greis et al.

(10) Patent No.: US 10,422,251 B2
(45) Date of Patent: Sep. 24, 2019

(54) METHOD FOR COOLING A STEAM TURBINE

(71) Applicant: Siemens Aktiengesellschaft, Munich (DE)

(72) Inventors: Jan Greis, Duisburg (DE); Oliver Stawarski, Neuss (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/735,472

(22) PCT Filed: Jun. 8, 2016

(86) PCT No.: PCT/EP2016/062963
§ 371 (c)(1),
(2) Date: Dec. 11, 2017

(87) PCT Pub. No.: WO2016/206972
PCT Pub. Date: Dec. 29, 2016

(65) Prior Publication Data

US 2018/0163572 A1 Jun. 14, 2018

(30) Foreign Application Priority Data

Jun. 24, 2015 (EP) ..... 15173619

(51) Int. Cl.
*F01K 13/02* (2006.01)
*F01K 7/16* (2006.01)
*F01K 13/00* (2006.01)

(52) U.S. Cl.
CPC ..... *F01K 13/02* (2013.01); *F01K 7/16* (2013.01); *F01K 13/003* (2013.01); *F05D 2220/31* (2013.01)

(58) Field of Classification Search
CPC ..... F01K 13/02; F01K 7/16; F01K 13/003; F01D 25/12; E21B 43/24
See application file for complete search history.

(56) References Cited

U.S. PATENT DOCUMENTS 3,588,265 A * 6/1971 Berry ..... F01D 19/02 415/1
4,179,742 A * 12/1979 Stern ..... F01K 13/02 290/40 R (Continued)

FOREIGN PATENT DOCUMENTS

AU 2008202733 A1 1/2009
EP 2620604 A1 7/2013

(Continued)

OTHER PUBLICATIONS

EP Search Report dated Dec. 10, 2015, for EP patent application No. 15173619.6.

(Continued)

*Primary Examiner* — Mark A Laurenzi
*Assistant Examiner* — Shafiq Mian
(74) *Attorney, Agent, or Firm* — Beusse Wolter Sanks & Maire

(57) ABSTRACT

An automation system that determines the theoretical maximum rate of cooling of a steam turbine and operates a steam generator in such a way that the thermal energy of the steam does not exceed nor drop below the predefined rate of cooling.

5 Claims, 1 Drawing Sheet

(56) References Cited

U.S. PATENT DOCUMENTS

| | | | | |
|---|---|---|---|---|
| 4,213,935 | A * | 7/1980 | Goodnight | B01J 19/14 422/111 |
| 4,227,093 | A * | 10/1980 | Uram | F01D 19/00 290/40 R |
| 5,433,079 | A * | 7/1995 | Badami | F01D 19/02 60/646 |
| 8,984,894 | B2 * | 3/2015 | Droux | C02F 1/16 60/795 |
| 2004/0148129 | A1 | 7/2004 | Gotoh et al. | |
| 2007/0051042 | A1 * | 3/2007 | Grover | B01D 53/047 48/198.3 |
| 2014/0216717 | A1 * | 8/2014 | O'Donnell | E21B 43/24 166/90.1 |
| 2015/0047353 | A1 * | 2/2015 | Riemann | F01D 25/12 60/646 |

FOREIGN PATENT DOCUMENTS

| | | | |
|---|---|---|---|
| JP | S5022189 | A | 3/1975 |
| JP | 2007138856 | A | 6/2007 |
| JP | 2008039649 | A | 2/2008 |
| JP | 2009243364 | A | 10/2009 |
| JP | 2014084847 | A | 5/2014 |
| WO | 02103177 | A1 | 12/2002 |

OTHER PUBLICATIONS

International Search Report dated Sep. 21, 2017, for PCT/EP2016/062963.

IPRP (PCT/IPEA/408) dated May 30, 2017, for PCT/EP2016/062963.

IPEA (PCT/IPEA/416 and 409) dated Nov. 17, 2017, for PCT/EP2016/062963.

* cited by examiner

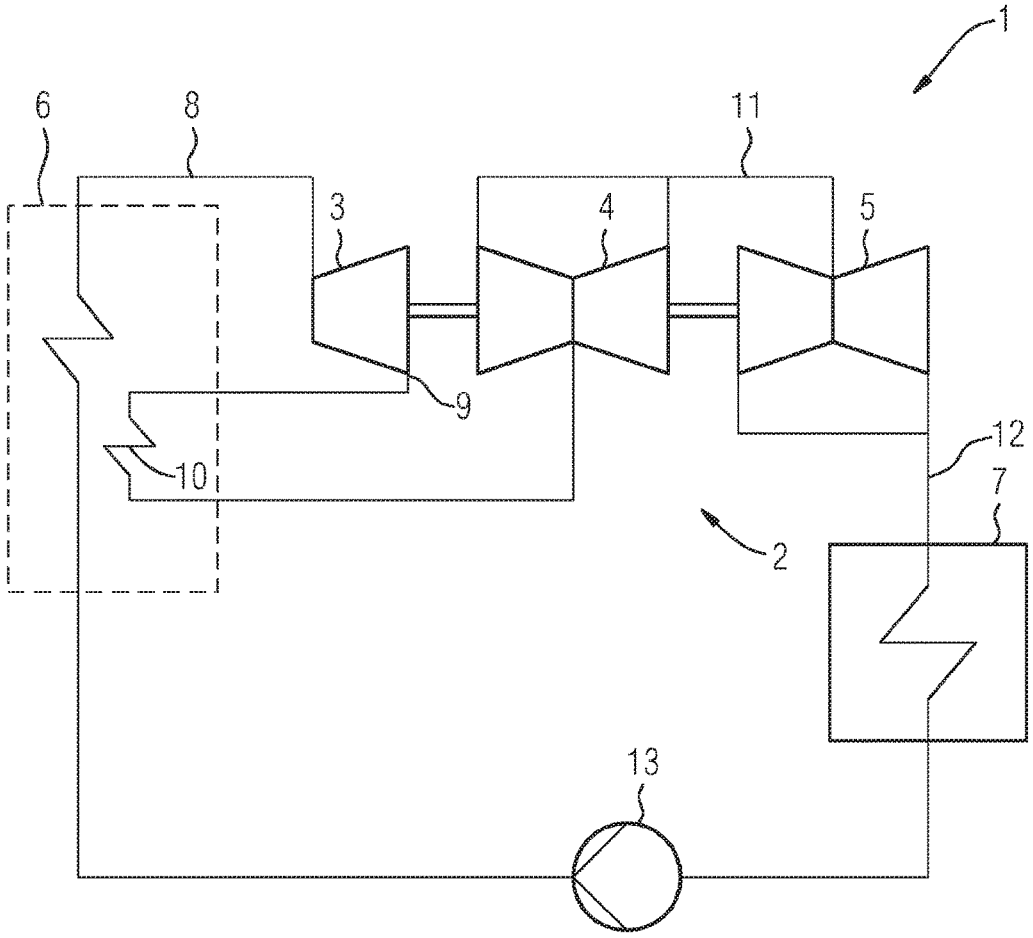
1
6
8
11
3
4
5
9
10
12
7
2
13

METHOD FOR COOLING A STEAM TURBINE

CROSS REFERENCE TO RELATED APPLICATIONS

This application is the US National Stage of International Application No. PCT/EP2016/062963 filed Jun. 8, 2016, and claims the benefit thereof. The International Application claims the benefit of European Application No. EP15173619 filed Jun. 24, 2015. All of the applications are incorporated by reference herein in their entirety.

FIELD OF INVENTION

The invention relates to a method for cooling a steam turbine wherein the steam turbine is charged with steam from a steam generator, wherein a predefined cooling rate $\dot{T}vor$ of the steam turbine is determined, wherein the actual cooling rate $\dot{T}tat$ is determined and is compared with the predefined cooling rate $\dot{T}vor$.

BACKGROUND OF INVENTION

Steam turbines are used in power plants for generating energy. Once commissioned, the steam turbines are operated more or less constantly. However, it is necessary now and again to carry out overhauls. This requires that the steam turbines be taken off-line and cooled. For cooling, it is routine practice to cool the steam turbine using so-called "forced cooling". In essence, "forced cooling" comprises three phases, wherein in the first phase the steam temperature is reduced during power operation and after switch-off, then natural cooling and finally "cold drawing" with ambient air, the air being drawn through the steam turbine by means of an evacuation device. Thus, the steam turbine undergoes preliminary cooling by means of a reduction in the steam temperature during power operation. This reduction in the steam temperature can be brought about by means of a boiler blow-off and/or by reducing the power of the firing or of the gas turbine (in the case of a combined cycle plant). However, it is necessary to attend that the reduction in steam temperatures takes place so as not to exceed the design limits of the steam turbine. To that end, the steam temperature can be reduced with fixed gradients. However, this has the drawback that any freedoms are not fully exhausted. In turn, this leads to a loss of time, in which valuable fuel could be squandered.

SUMMARY OF INVENTION

The invention therefore has an object of speeding up the method for cooling the steam turbine.

This object is achieved with the independent claim.

Accordingly, the invention uses a method for cooling a steam turbine, wherein the steam turbine is charged with steam from a steam generator, wherein a predefined cooling rate of the steam turbine is determined, wherein the actual cooling rate is determined and is compared with the predefined cooling rate and the steam generator is operated such that the actual cooling rate essentially corresponds to the predefined cooling rate.

Thus, an essential feature of the invention is that it considers regulation which now regulates the steam temperature such that the cooling of the steam turbine takes place within predefined limits.

Advantageous developments are specified in the dependent claims.

Thus, in a first advantageous development, the predefined cooling rate is determined using a finite element method, is determined by measurements or is determined by testing.

In another advantageous development, the cooling rate takes into account the temperature of the components, such as the casing and the rotor, of the steam turbine.

The object is also achieved with an automation system which is designed for carrying out the method according to the invention.

The above-described properties, features and advantages of this invention and the manner in which they are achieved become more clearly and distinctly comprehensible in conjunction with the following description of the exemplary embodiments which are explained in more detail in connection with the drawings.

Exemplary embodiments of the invention will be described hereinbelow with reference to the drawing. This is not intended as a definitive illustration of the exemplary embodiments, but rather the drawing, where conducive to clarification, is constructed in a schematized and/or slightly distorted form. With regard to additions to the teachings which are directly apparent in the drawing, reference is made to the relevant prior art.

BRIEF DESCRIPTION OF THE DRAWINGS

In the drawing:

FIG. 1 is a schematic illustration of a power plant installation according to the invention.

DETAILED DESCRIPTION OF INVENTION

The power plant installation 1 comprises a steam turbine 2 that is divided into a high-pressure turbine section 3, an intermediate-pressure turbine section 4 and a low-pressure turbine section 5. The power plant installation 1 also comprises a steam generator 6 and a condenser 7 that is fluidically connected to the low-pressure turbine section 5. Live steam is generated in the steam generator 6 and flows via a live steam line 8 into the high-pressure turbine section 3, and thence via an outlet 9 to a reheater 10. In the reheater 10, the steam is reheated to a higher temperature and then flows into the intermediate-pressure turbine section 4. Thence, the steam flows via a crossover pipe 11 to the low-pressure turbine section 5, and finally via a waste steam line 12 into the condenser 7. In the condenser 7, the steam condenses to water and is returned to the steam generator 6 by means of a pump 13.

The steam turbine 1 is charged with steam from the steam generator 6, in which context a predefined cooling rate $\dot{T}_{vor}$ of the steam turbine 2 is determined. Also, the actual cooling rate $\dot{T}_{tat}$ is determined and is compared with the predefined cooling rate $\dot{T}_{vor}$. This takes place in an automation system (not shown). The automation system sends an output signal to the steam generator 6, as a result of which the steam generator 6 is operated such that the actual cooling rate $\dot{T}_{tat}$ essentially corresponds to the predefined cooling rate $\dot{T}_{vor}$. Accordingly, the steam turbine is controlled in a manner that reflects the design limits, wherein a parameter for cooling is calculated and is made available to the steam generator 6 as a signal. This optimum steam temperature makes optimum use of the design limits of the steam turbine 2 during cooling. It constantly monitors the actual states and compares these with the permitted limits. In other words, with the automation system, the optimum steam temperature will lower the temperature rapidly when large margins still exist, and more slowly when only small margins exist, for example close to the design limit. In this context, temperatures of the steam turbine and thus the wall temperature limits are taken into account.

The predefined cooling rate can be determined using a finite element method, or by measurements or by testing.

Although the invention has been described and illustrated in detail by way of the preferred exemplary embodiment, the invention is not restricted by the disclosed examples and other variations can be derived herefrom by a person skilled in the art without departing from the scope of protection of the invention.

The invention claimed is:

1. A method for cooling a steam turbine, comprising:

operating a steam generator during a cooling operation comprising a boiler blow-off or a change in firing effective to reduce a power of the steam generator, charging the steam turbine with steam from the steam generator during the cooling operation, determining a predefined cooling rate $\dot{T}_{vor}$ of the steam turbine, determining an actual cooling rate $\dot{T}_{tat}$ during the cooling operation and comparing the actual cooling rate $\dot{T}_{tat}$ with the predefined cooling rate $\dot{T}_{vor}$, and controlling operation of the steam generator during the cooling operation such that the actual cooling rate $\dot{T}_{tat}$ corresponds to the predefined cooling rate $\dot{T}_{vor}$.

2. The method as claimed in claim 1, wherein the predefined cooling rate $\dot{T}_{vor}$ is determined using a finite element method, is determined by measurements, or is determined by testing.

3. The method as claimed in claim 1, wherein the actual cooling rate takes into account temperatures of components of the steam turbine.

4. The method as claimed in claim 3, further comprising:

determining a temperature at an inner casing wall $T_I$ and a temperature at an outer casing wall $T_A$ and ensuring a difference in temperature $T_A - T_I$ remains within predefined limits.

5. An automation system, wherein the automation system is designed for carrying out a method as claimed in claim 1.

* * * * *